US007147488B2

(12) United States Patent
Chen

(10) Patent No.: US 7,147,488 B2
(45) Date of Patent: Dec. 12, 2006

(54) MODULE STRUCTURE OF AC CONNECTOR

(75) Inventor: Chun-Chen Chen, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 10/982,493

(22) Filed: Nov. 5, 2004

(65) Prior Publication Data

US 2005/0196986 A1 Sep. 8, 2005

(30) Foreign Application Priority Data

Mar. 3, 2004 (TW) ..... 93105598 A

(51) Int. Cl.
*H01R 12/00* (2006.01)

(52) U.S. Cl. ..... 439/79

(58) Field of Classification Search ..... 439/79, 439/80, 620, 81, 541.5
See application file for complete search history.

(56) References Cited

U.S. PATENT DOCUMENTS 2,800,637 A * 7/1957 Nicolaus ..... 439/874
3,437,774 A * 4/1969 Snider ..... 200/275
4,196,960 A * 4/1980 Gelfand ..... 439/874
4,470,648 A * 9/1984 Davis et al. ..... 439/68
4,913,678 A * 4/1990 Avellino et al. ..... 439/879
5,895,276 A * 4/1999 Rothenberger ..... 439/67
5,906,510 A * 5/1999 Lwee ..... 439/541.5
5,954,522 A * 9/1999 Ho et al. ..... 439/79
6,759,594 B1 * 7/2004 Iijima et al. ..... 174/135

* cited by examiner

*Primary Examiner*—Phuong Dinh

(57) ABSTRACT

A module structure of an AC connector applied to an electronic device is disclosed. The module structure of the AC connector at least includes an isolation main body having a through hole and an opening, an integrally formed conducting element, a holding element and a connecting element. The integrally formed conducting element has a conducting terminal located in the through hole and a conducting piece protruded out of the opening. The holding element is disposed at a top end of the conducting piece and connected to one end of the connecting element, and the other end of the connecting element is connected with a circuit board of the electronic device.

20 Claims, 5 Drawing Sheets

MODULE STRUCTURE OF AC CONNECTOR

FIELD OF THE INVENTION

The present invention is related to a module structure of an AC connector, and more particularly to a module structure of an AC connector applied to an electronic device, such as an adapter.

BACKGROUND OF THE INVENTION

Generally, for adapting to AC cables with different specifications and sizes in various countries, an adapter usually includes an AC connector for electrically connecting with the AC cables.

Traditionally, an AC connector is positioned on a circuit board inside an adapter in a plugging manner. Please refer to FIGS. 1(*a*) and 1(*b*), which are schematic views showing a conventional AC connector. The conventional AC connector 10 mainly includes an isolation main body 101 having a through hole 102 formed therein, and the through hole 102 further includes a first conducting terminal 103 and a second conducting terminal 104 mounted thereinside, wherein the first conducting terminal 103 and the second conducting terminal 104 pass through openings (not shown) located at the rear of the main body 101 and are connected to a first pin 105 and a second pin 106 respectively by a welding or riveting manner. Moreover, a supporting rod with a protruding structure 107 is further mounted at the bottom of the main body 101 of the AC connector 10. Thus, through engaging the protruding structure 107 of the supporting rod with the plugging holes 111 and 112 on the circuit board 11 disposed inside the adapter, the AC connector 10 can be fixed on the circuit board 11. Besides, the first pin 105 and the second pin 106 can extend downwardly to be plugged into pin holes 113 and 114 on the circuit board 11 and then welded on the circuit board 11, so that the AC power received by the first conducting terminal 103 and the second conducting terminal 104 can be conducted to the circuit board 11.

However, the AC connector described above actually has some unavoidable defects. First of all, because the first pin and the second pin are downwardly extended into the pin holes on the circuit board, the distance between the two pin holes should be matched with that between the first and the second pins, and it is therefore disadvantageous for the AC connector to be applied to other circuit boards with different standards. Furthermore, because the first and the second pins are made of metal material and must be perpendicularly and directly plugged into the circuit board as assembling and then welded on the circuit board, the first and the second pins are actually inflexible. Therefore, they cannot eliminate the heat stress produced by electronic elements on the circuit board as being operated, so that the welding material at the weld point comes off easily.

Hence, a design that connects the AC connector and the circuit board inside the electronic device through a connecting wire is developed. Please refer to FIG. 2, which is a schematic view showing an AC connector in the market. As shown in FIG. 2, the AC connector 20 at least includes an isolation main body 201, a first conducting terminal 203, a second conducting terminal 204, a first conducting piece (not shown), and a second conducting piece 205, wherein a through hole 202 is formed in the main body 201 and the first conducting terminal 203 and the second conducting terminal 204 are disposed thereinside. The first conducting terminal 203 and the second conducting terminal 204 pass through openings (not shown) at the rear of the main body 201 and are connected to the first conducting piece (not shown) and the second conducting piece 205 respectively by welding or riveting. Through a connecting wire 206 connecting the conducting piece 205 and the circuit board inside the electronic-device (not shown), the AC connector 20 is electrically conducted with the electronic device (not shown). However, although many defects existed in the conventional AC connector can be solved by means of the connecting wire used in this design and the AC connector can thus be applied to all kinds of circuit boards, an additional welding or riveting step must be performed during the assembling procedure since the conducting terminal and the conducting piece must be connected in a welding or riveting manner. Besides, because the volumes of the conducting terminals and the conducting pieces are all small, the direct welding or riveting at the rear of the AC connector may cause the isolation main body, which is almost made of plastic material, melted owing to the high temperature.

Consequently, how to improve the whole structure of the AC connector for avoiding the defects described above and further reducing the manufacturing cost has become a challenge for the manufacturer.

SUMMARY OF THE INVENTION

The object of the present invention is to provide a module structure of an AC connector whose conducting element is integrally formed by bending one single metal, and thus, the welding or riveting step employed in the prior arts can be eliminated. On the other hand, the technique of connecting the electronic device and the AC connector by a holding element, which is disposed at the top end of the conducting element for fixing the connecting wire or pin, can considerably reduce the manufacturing cost and time, and further, the application problem of the circuit board can also be solved.

In accordance with one aspect of the present invention, a module structure of an AC connector for an electronic device at least comprises an isolation main body having a through hole and an opening, at least a conducting element having a conducting terminal and a conducting piece, wherein the conducting terminal and the conducting piece are integrally formed, the conducting terminal is located in the through hole, and the conducting piece is protruded out of the opening, a holding element disposed at a top end of the conducting piece, and a connecting element having one end connected to the holding element and the other end connected to a circuit board of the electronic device.

For example, the electronic device is an adapter, a power supply or a transformer, and the circuit board is a printed circuit board.

In an embodiment, the conducting terminal is a hollow metal stick and the conducting piece is a metal flake. Preferably, the holding element and the conducting element are integrally formed, and the holding element and the conducting element are formed through bending one single metal material.

In an embodiment, the holding element is a holding ring for bearing the connecting element so as to electrically conduct the AC connector with the electronic device. Alternatively, the holding element is a U-shaped element. In another embodiment, the holding element comprises plural holes.

For example, the connecting element is a connecting wire or a pin.

In accordance with another aspect of the present invention, an electronic device at least comprises a circuit system disposed inside the electronic device, an inlet positioned at a side of the electronic device, and a module structure of an AC connector located in the inlet. The module structure of the AC connector comprises an isolation main body having a through hole and an opening, at least a conducting element having a conducting terminal and a conducting piece, wherein the conducting terminal and the conducting piece are integrally formed, the conducting terminal is located in the through hole, and the conducting piece is protruded out of the opening, a holding element disposed at a top end of the conducting piece, and at least a connecting element having one end connected with the circuit system and the other end connected with the module structure of the AC connector so as to electrically conduct the AC connector and the electronic device.

For example, the electronic device is an adapter, a power supply or a transformer, and the circuit board is a printed circuit board.

In an embodiment, the conducting terminal is a hollow metal stick and the conducting piece is a metal flake. Preferably, the holding element and the conducting element are integrally formed, and the holding element and the conducting element are formed through bending one single metal material.

In an embodiment, the holding element is a holding ring for bearing the connecting element so as to electrically conduct the AC connector with the electronic device. Alternatively, the holding element is a U-shaped element. In another embodiment, the holding element comprises plural holes.

For example, the connecting element is a connecting wire or a pin.

The above objects and advantages of the present invention will become more readily apparent to those ordinarily skilled in the art after reviewing the following detailed descriptions and accompanying drawings, in which:

DETAILED DESCRIPTION OF THE PREFERRED EMBODIMENT

The present invention is related to a module structure of an AC connector which can be applied to an electronic device, such as an adapter, a power supply or a transformer. In the module structure of the AC connector of the present invention, the conducting element has a conducting terminal and a conducting piece which are formed integrally, so as to overcome the defects caused by the welding or riveting process that is to connect the conducting terminal and the conducting piece, and simultaneously reduce the manufacturing cost and bad production. The embodiments below will further explain the details of the module structure of the AC connector of the present invention, which is applied to an adapter for example. However, the present invention is not limited thereto and other techniques or designs applicable to the present invention are also incorporated herein for reference.

Figure 1A:
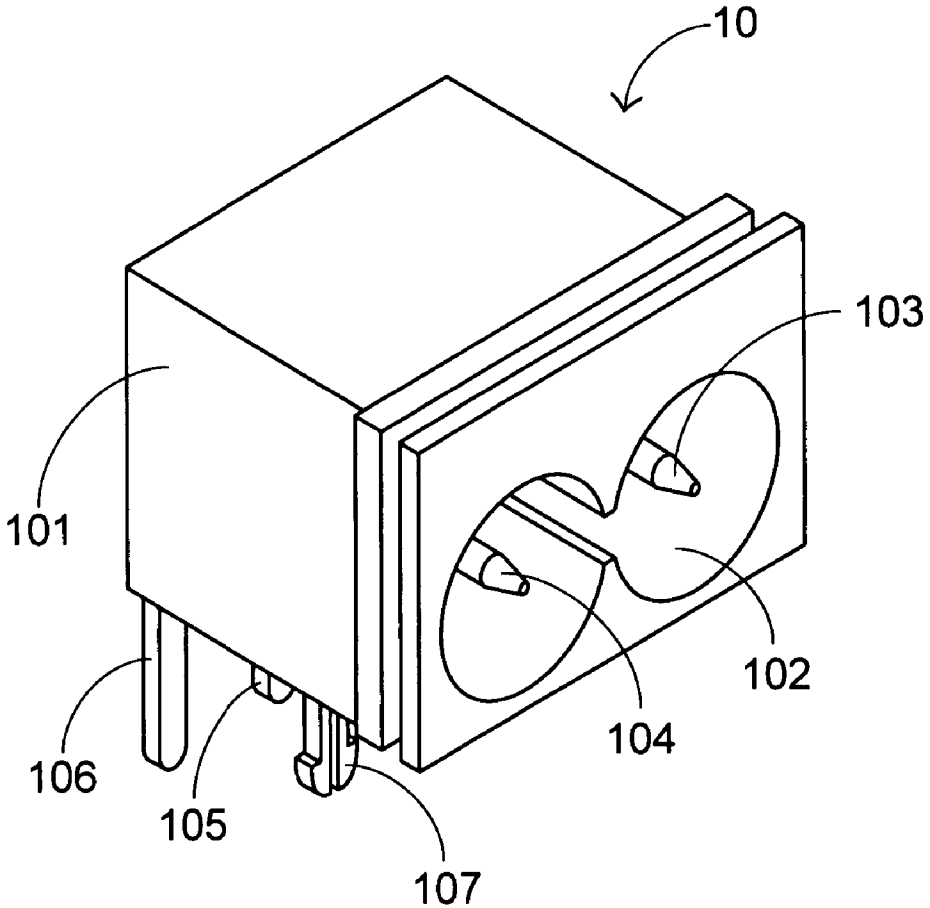
Fig. 1(a) (Prior Art)
FIGS. 1(*a*) and 1(*b*) are schematic views showing a conventional AC connector.
Figure 1B:
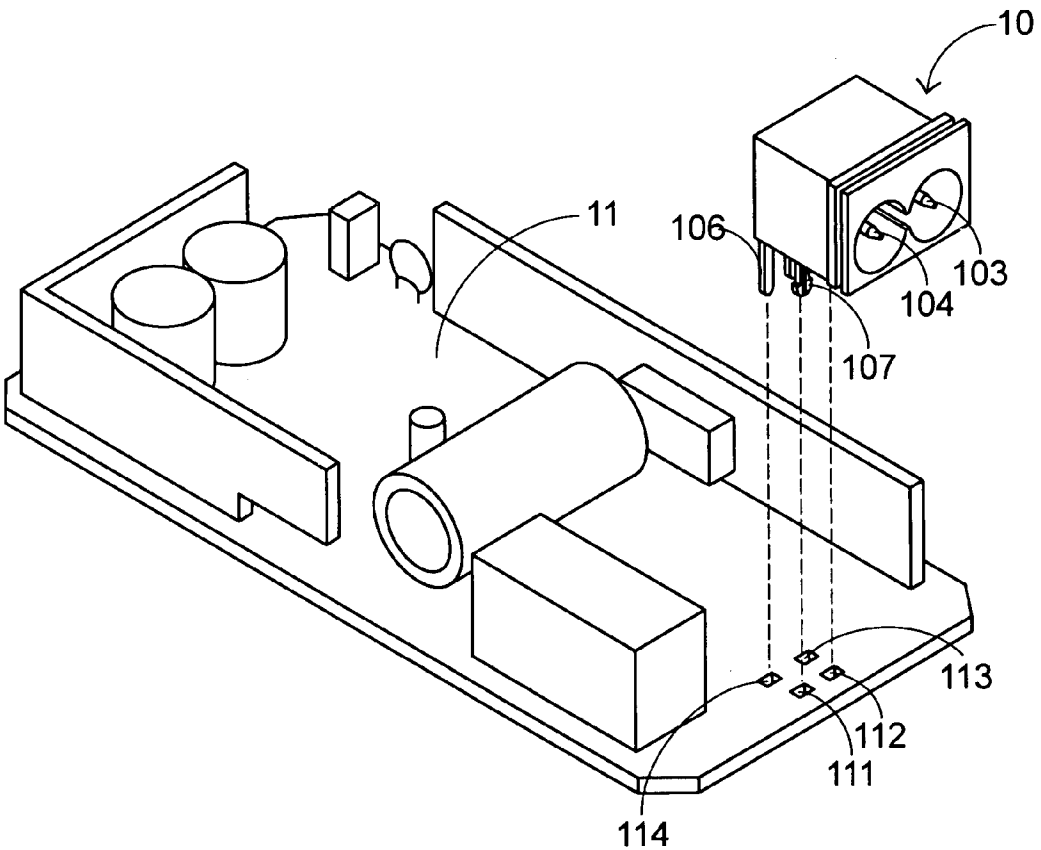
Fig. 1(b) (Prior Art)
Figure 2:
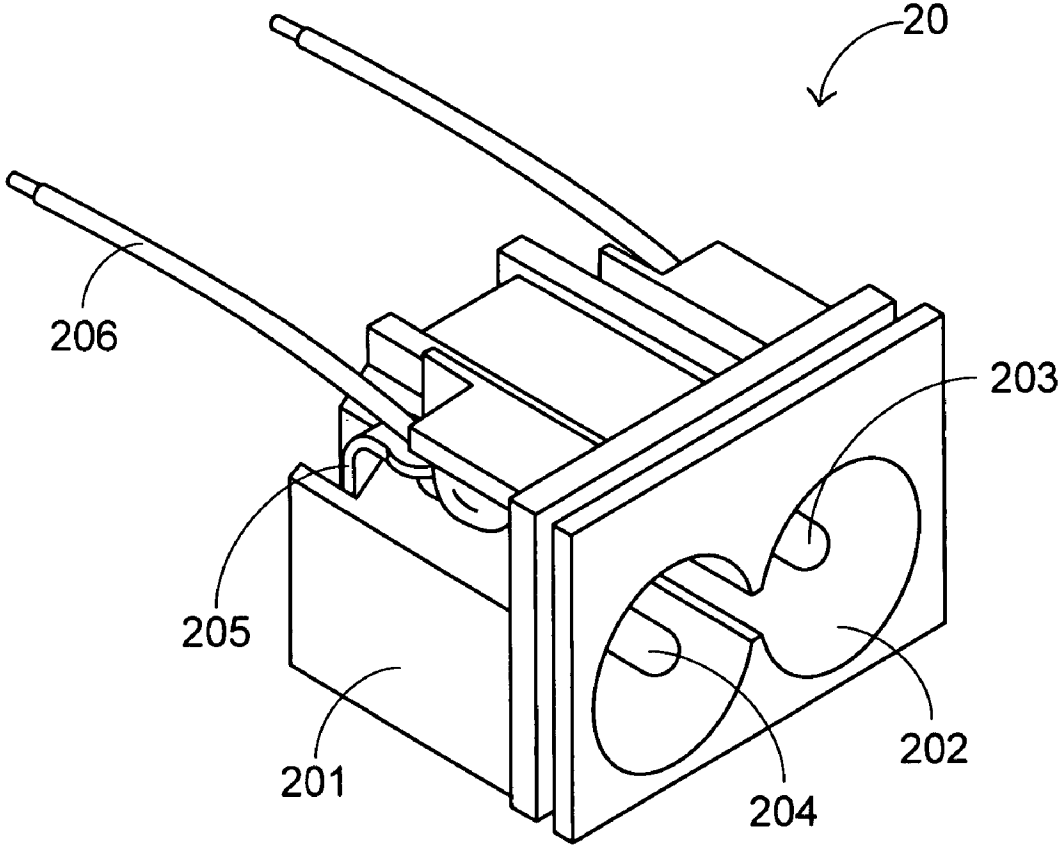
Fig. 2 (Prior Art)
FIG. 2 is a schematic view showing an AC connector in the market.
Figure 3:
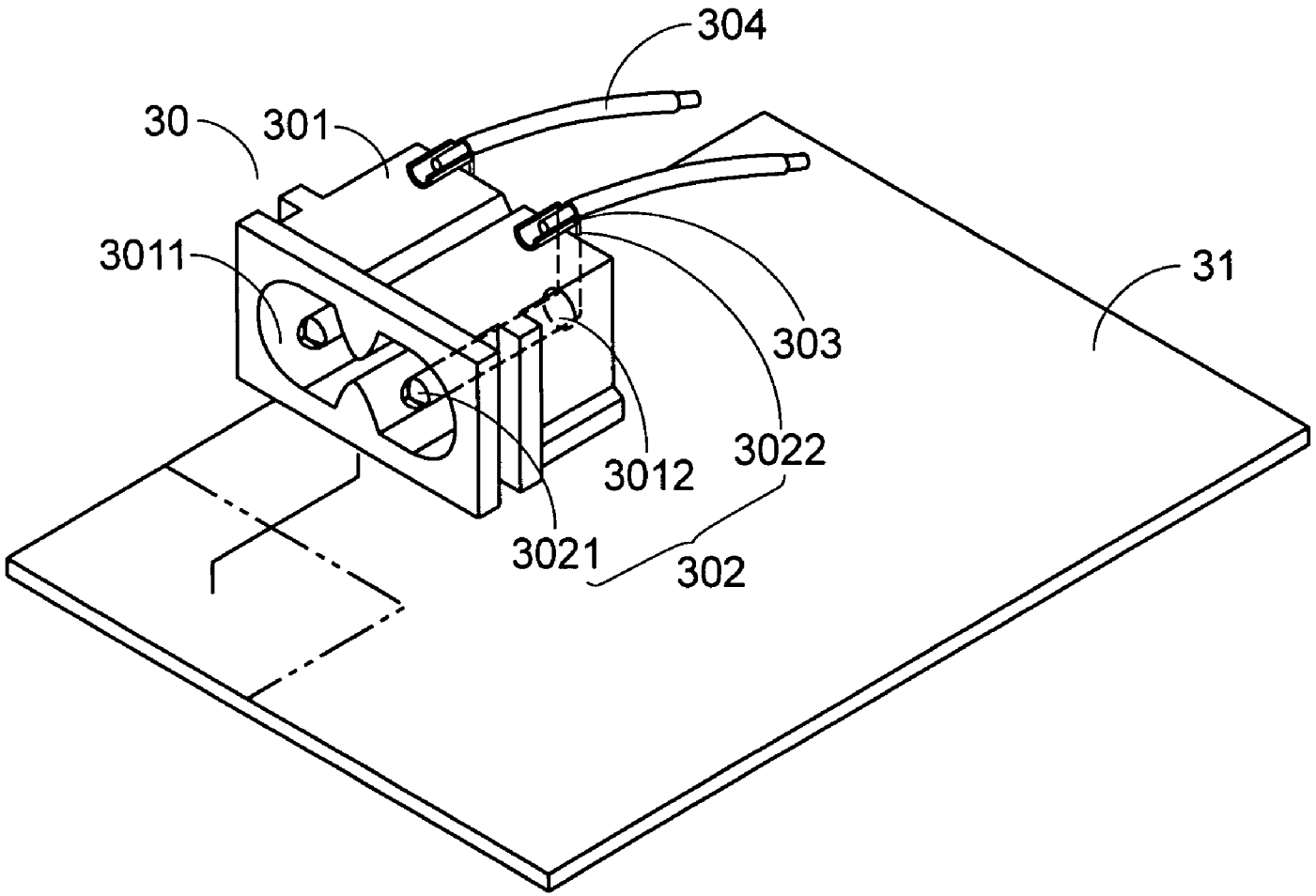
FIG. 3 is a schematic view showing a module structure of an AC connector according to the first preferred embodiment of the present invention.

Please refer to FIG. 3, which is a schematic view showing a module structure of an AC connector according to the first preferred embodiment of the present invention. As shown in FIG. 3, the module structure of the AC connector 30 mainly comprises an isolation main body 301, a conducting element 302, a holding element 303 and a connecting element 304, wherein the main body 301 has a through hole 3011 and an opening 3012 at the rear of the main body 301. The conducting element 302 has a conducting terminal 3021 disposed in the through hole 3011 and a conducting piece 3022 protruded out of the opening 3012, and the conducting terminal 3021 and the conducting piece 3022 are integrally formed. Furthermore, the holding element 303 is positioned at the top end of the conducting piece 3022 of the conducting element 302 for fixing one end of the connecting element 304, and the other end of the connecting element 304 is connected with a circuit board 31 of the electronic device, so that the AC connector and the electronic device are electrically conducted thereby.

In this embodiment of the present invention, the conducting element is made of metal material, and the conducting terminal and the conducting piece are integrally formed in a bending manner so that the conducting terminal is substantially shaped as a hollow metal stick and the conducting piece is substantially shaped as a flake. Certainly, the holding element and the conducting element also can be formed integrally, that is to say, through bending one single metal, the conducting terminal, the conducting piece and the holding element can be formed at the same time. The shape of the holding element is not limited, but for beneficially fixing the connecting element, which is mostly a connecting wire, it is better to be shaped as a holding ring or a U-shaped element, so that the purpose of bearing the connecting element can be simultaneously achieved. Then, via the other end of the connecting element connected with the circuit board of the electronic device, the AC connector and the electronic device can be electrically conducted. It is noted that through this design, the defects caused by welding or riveting the conducting element in the prior arts can be avoided, and further, through fixing the connecting element in a holding manner of this design, the inconvenient connection between the AC connector and the electronic device in the prior arts or the welding defects can be eliminated.

Figure 4:
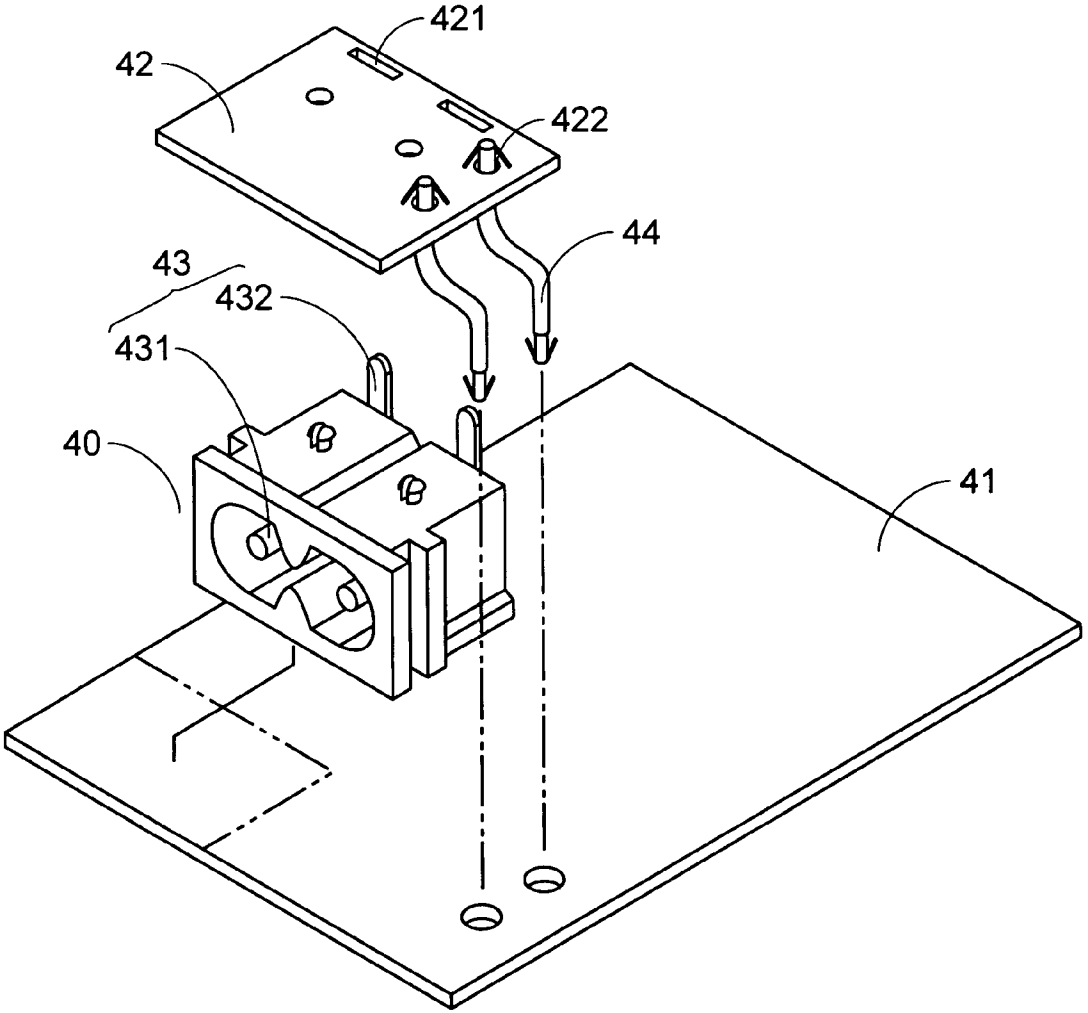
FIG. 4 is a schematic view showing a module structure of an AC connector according to the second preferred embodiment of the present invention.

Certainly, the holding element of the present invention is not limited to the metal holding ring shown in FIG. 3 or the like. Please refer to FIG. 4, which is a schematic view showing a module structure of an AC connector according to the second preferred embodiment of the present invention. As shown in FIG. 4, the holding element 42 comprises plural holes 421 and 422 whose sizes and shapes are matched to those of the conducting pieces 432 of the conducting elements 43 and the connecting elements 44. Naturally, other holes also can be formed on the holding element 42 according to other demands. The conducting pieces 432 of the conducting elements 43 are correspondingly positioned into the predetermined holes 421 on the holding element 42, and at the same time, the connecting elements 44 are positioned into other holes 422. Obviously, if desired, a conductive wiring may be disposed between the holes 421 and the holes 422. Accordingly, the other end of the connecting element 44 can therefore be employed to connect with the circuit board 41 of the electronic device (not shown) so as to electrically conduct the AC connector 40 and the electronic device (not shown). Identically, because the conducting terminal 431 and the conducting piece 432 of the conducting element 43 are integrally formed, the welding or riveting step used in the prior arts can be eliminated. Therefore, not only the manufacturing cost but also the manufacturing time can be reduced, and the defects caused by the conventional technique can be avoided. Furthermore, for the circuit board inside the electronic device, according to the design in this embodiment, the area for disposing the circuit elements can accordingly be increased, and even more, the research and development for miniaturizing the whole adapter can also be improved.

In view of the aforesaid, because the conducting element of the module structure of the AC connector according to the present invention is integrally formed, the step for connecting the conducting terminal with the conducting piece can be eliminated. Accordingly, not only the equipment for welding or riveting can be saved to reduce the manufacturing cost and time, but the melt influence of the high temperature generated during the welding or riveting step on the isolation main body of the AC connector can also be eliminated. Furthermore, according to the embodiments of the present invention, the connecting element can be fixed and protected, the wiring area on the circuit board can be increased, and the applicable electronic device may be miniaturized. Therefore, the present invention provides a module structure of an AC connector with a great advancement, and thus owns industrial value.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A module structure of an AC connector for an electronic device, comprising:

an isolation main body having a through hole and an opening;

at least a conducting element having a conducting terminal and a conducting piece, wherein said conducting terminal and said conducting piece are integrally formed, said conducting terminal is located in said through hole and said conducting piece is protruded out of said opening;

a holding element disposed at a top end of said conducting piece and over the isolation main body; and a connecting element having one end held by said holding element and the other end connected with a circuit board of said electronic device.

2. The module structure of the AC connector according to claim 1, wherein said electronic device is one selected from a group consisting of an adapter, a power supply and a transformer.

3. The module structure of the AC connector according to claim 1, wherein said conducting terminal is a hollow metal stick.

4. The module structure of the AC connector according to claim 1, wherein said conducting piece is a metal flake.

5. The module structure of the AC connector according to claim 1, wherein said holding element and said conducting element are integrally formed.

6. The module structure of the AC connector according to claim 5, wherein said holding element and said conducting element are formed through bending one single metal material.

7. The module structure of the AC connector according to claim 1, wherein said holding element is a holding ring for bearing said connecting element so as to electrically conduct said AC connector with said electronic device.

8. The module structure of the AC connector according to claim 1, wherein said holding element is a U-shaped element.

9. The module structure of the AC connector according to claim 1, wherein said holding element comprises plural holes.

10. The module structure of the AC connector according to claim 1, wherein said connecting element is one of a connecting wire and a pin.

11. An electronic device, comprising:

a circuit system disposed inside said electronic device;

an inlet positioned at a side of said electronic device; and a module structure of an AC connector located in said inlet, comprising:

an isolation main body having a through hole and an opening;

at least a conducting element having a conducting terminal and a conducting piece, wherein said conducting terminal and said conducting piece are integrally formed, said conducting terminal is located in said through hole and said conducting piece is protruded out of said opening;

a holding element disposed at a top end of said conducting piece and over the isolation main body; and at least a connecting element having one end connected with said circuit system and the other end held by said holding element of said module structure of said AC connector so as to electrically conduct said AC connector and said electronic device.

12. The electronic device according to claim 11, wherein said electronic device is one selected from a group consisting of an adapter, a power supply and a transformer.

13. The electronic device according to claim 11, wherein said conducting terminal is a hollow metal stick.

14. The electronic device according to claim 11, wherein said conducting piece is a metal flake.

15. The electronic device according to claim 11, wherein said holding element and said conducting element are integrally formed.

16. The electronic device according to claim 15, wherein said holding element and said conducting element are formed through bending one single metal material.

17. The electronic device according to claim 11, wherein said holding element is a holding ring for bearing said connecting element so as to electrically conduct said AC connector with said electronic device.

18. The electronic device according to claim 11, wherein said holding element is a U-shaped element.

19. The electronic device according to claim 11, wherein said holding element comprises plural holes.

20. The electronic device according to claim 11, wherein said connecting element is one of a connecting wire and a pin.

* * * * *